US005358246A

United States Patent [19]

Dziedzic

[11] Patent Number: 5,358,246

[45] Date of Patent: Oct. 25, 1994

[54] CARD HOLDER AND SIGNAL DEVICE

[76] Inventor: Jerome J. Dziedzic, 5350 S. Cambridge La., Greenfield, Wis. 53221

[21] Appl. No.: 202,515

[22] Filed: Feb. 28, 1994

[51] Int. Cl.[5] ..... A63F 9/00

[52] U.S. Cl. ..... 273/148 A; 273/148 R; 40/658; 294/19.1

[58] Field of Search ..... 273/148 A, 148 R, 309, 273/269; 40/658, 606, 610, 666; 294/19.1

[56] References Cited

U.S. PATENT DOCUMENTS

| | | | |
|---|---|---|---|
| 1,996,234 | 4/1935 | Deinstein | 273/150 |
| 2,520,490 | 8/1950 | Boward | 273/150 |
| 3,889,409 | 6/1975 | Thomas | 40/606 |
| 4,502,658 | 3/1985 | Wirt et al. | 273/148 A |
| 4,572,510 | 2/1986 | Green | 273/148 R |
| 4,925,143 | 5/1990 | Sandmeyer | 248/441.1 |
| 4,948,139 | 8/1990 | Heeszel | 273/148 A |

*Primary Examiner*—Benjamin H. Layno

*Attorney, Agent, or Firm*—Andrus, Sceales, Starket & Sawall

[57] ABSTRACT

A holder for displaying a bingo card for pickup includes a pair of vertically extensible wire rods, the lower one of which is attached to a supporting base and the upper one of which includes an integral wire clip for releasably holding the card or other thin sheet materials. The clipped card may be held and displayed for pickup by extending the upper rod member to hold the material above the player's table. The extensible rods are preferably demountable from the base and the base provided with receptacles for other bingo-playing accessories. The holder, base and accessories may be conveniently packaged and sold as a kit.

10 Claims, 2 Drawing Sheets

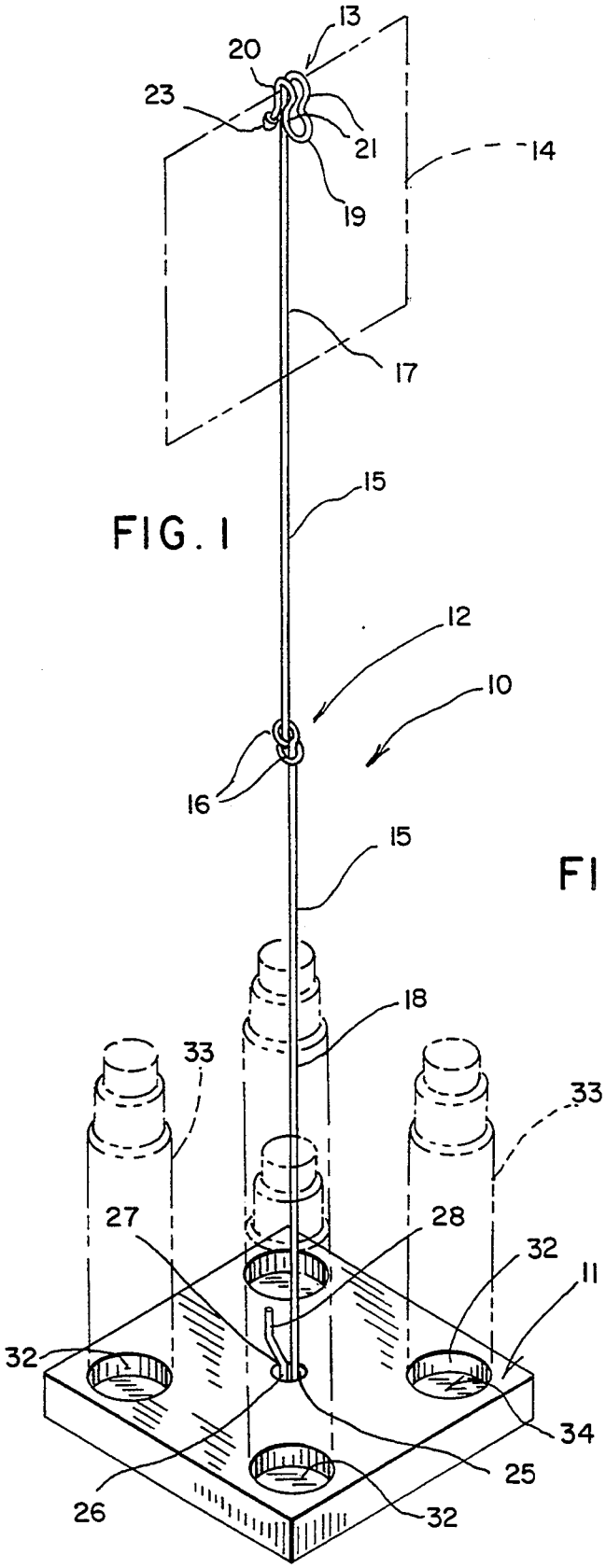
FIG. 1
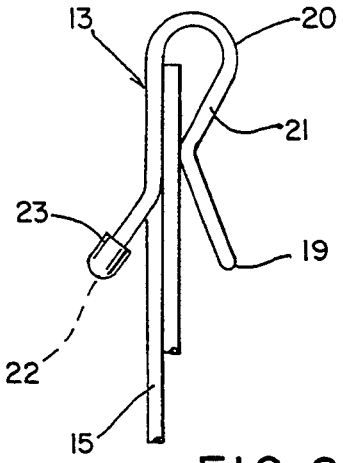
FIG. 2
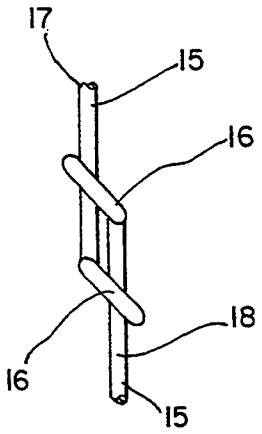
FIG. 3
FIG. 4
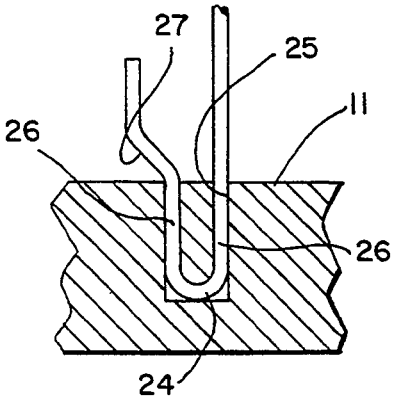

CARD HOLDER AND SIGNAL DEVICE

BACKGROUND OF THE INVENTION

The present invention pertains to a holder and signaling device for releasably displaying a card or the like and which is particularly useful for players of bingo and similar games.

Many devices are known in the prior art for holding the cards of a player playing a card game. Such devices are shown, for example, in U.S. Pat. Nos. 1,996,234 and 2,520,490. The former includes individual spring clips into which a card can be inserted and releasably held. The latter shows a groove-like card holder supported on a base. U.S. Pat. No. 4,572,510 shows an extensible hand-held indicator for a bingo player. It includes a telescoping handle, the lower end of which is held by the player and the upper end carrying a sign indicating a win.

However, in playing bingo and similar games, where large numbers of players are involved, such as in a casino or the like, it is often necessary or desirable for a player to exchange a card, purchase a new card or cards, or both. Typically, the player holds the card and/or the currency in the air by extending his or her arm vertically. Oftentimes, the attendant cannot reach the player to pick up the card or currency for a substantial period of time, during which the player's arm may become quite tired. This is particularly difficult for players who may have physical handicaps or somewhat impaired arm strength. In addition, the time spent by a player holding a card or currency in the air detracts from the ability of the player to continue other activities.

SUMMARY OF THE INVENTION

The present invention comprises a simple and easily operable holder and signal device that is particularly adapted to assist a bingo player in exchanging or purchasing new cards or the like. The holder includes a base, adapted to be placed on a table or similar surface, a pair of extensibly connected elongate members including a lower member attached to the base and an upper member having a clip on the upper end to receive and releasably hold sheet material, such as cards, and a slide mechanism which interconnects the upper end of the lower member and the lower end of the upper member for relative sliding movement between an extended upper position and a retracted lower position.

Each of the elongate members preferably comprises a straight wire rod. The slide mechanism comprises an integral wire loop formed on the upper and lower ends, respectively, of the lower and upper rods, each of which loops has the wire rod of the other member extending through it with the loops sized and positioned to allow the rods to slide relative and parallel to one another and to be held by friction in any selected position. Each of the loops is formed to lie in a plane at an acute angle with respect to the wire rod to which it is attached and to lie parallel to the plane of the other loop when interconnected.

Preferably, the clip comprises a unitary spring clamp which is integrally formed in the end of the upper wire rod. To facilitate removal of the card, the spring clip preferably includes a pair of downwardly opening friction jaws. Alternately, the spring clip may comprise a pair of abutting circular wire convolutions.

In one embodiment, the lower end of the lower rod is attached to the base with a demountable connection. The demountable connection includes a U-shaped turn formed on the end of the lower rod and a vertical hole in the base which is adapted to receive and frictionally hold the legs of the U-shaped turn.

The base may be made of a wide variety of materials, including wood, molded plastic and cast metal. The base may be provided with recesses for holding other bingo playing equipment, such as bingo markers. The card holder and signal device may be combined with a set of bingo markers or other items in a kit for bingo players.

BRIEF DESCRIPTION OF THE DRAWINGS

FIG. 1 is a perspective view of the preferred embodiment of the subject invention.

FIG. 2 is an enlarged detail of the spring clip at the upper end of the holder.

FIG. 3 is an enlarged detail of the adjustable interconnection between the upper and lower extensible card holder members.

FIG. 4 is an enlarged detail of the lower end of the lower member showing the demountable connection to the base.

DETAILED DESCRIPTION OF THE PREFERRED EMBODIMENTS

Figure 5:
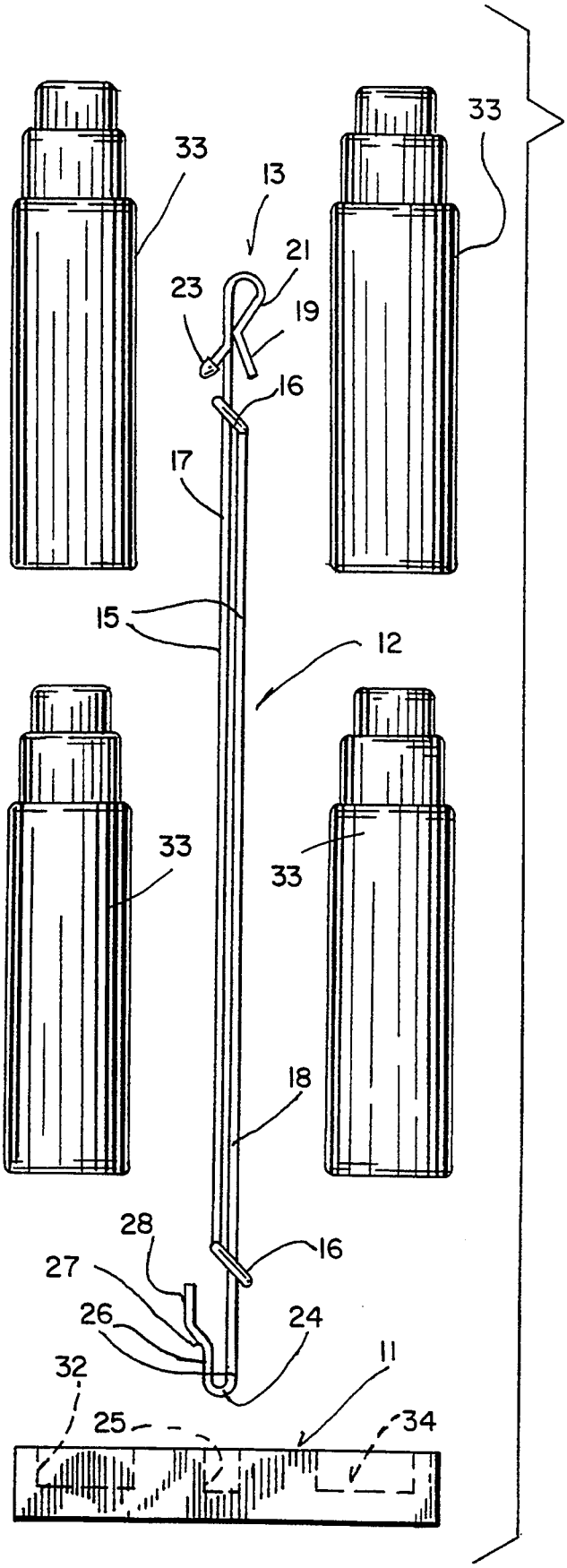
FIG. 5 is an exploded view of a bingo playing kit including the subject invention and accessories used therewith.

The holder and signaling device 10 of the present invention includes a base 11 and a vertically extensible member 12 attached to the base and having a clip 13 attached to its upper end. The base may be made of a wide variety of materials, including wood, metal and plastic. The base 11 should have enough mass to provide stability when it is placed on a table top and the member 12 extended to position the clip 13 and sheet material, such as a conventional bingo card 14, approximately 2–2½ feet in the air.

In its preferred embodiment, the vertically extensible member 12 comprises a pair of interconnected wire rods 15 which may be made, for example, from stainless steel spring wire of 0.062 inch (1.6 mm) diameter. One end of each wire rod 15 is formed with a small circular loop 16 approximately 0.25 inch (6.4 mm) in diameter. Each of the loops 16 is also bent at the point of connection to the straight portion of the rod 15 at an acute angle with respect to the axis of the rod. The angle at which the loop is bent is selected to allow the end of the other wire rod 15 to be inserted therethrough, as best shown in FIG. 3, without significant bending of the straight portions of the rods 15. When so interconnected, the rods may be slid relative and parallel to one another and held by friction in any selected position between fully extended with the loops 16 closely adjacent one another, as shown in FIG. 1, to fully retracted with the wire rods 15 lying side by side and the clip 13 on the upper rod 17 lying closely adjacent the loop 16 on the upper end of the lower rod 18, as shown in FIG. 5.

The clip 13 preferably comprises a spring clamp 20 formed by bending the upper end of the upper rod 17. In the preferred embodiment shown in FIGS. 1-2, the wire is bent to form two pairs of clamping jaws 21 integrally connected with a bent circular portion 19. The terminal end 22 of the wire forming the endmost jaw on the rod 17 may be provided with a protective rubber tip 23.

The lower end of the lower rod 18 may be secured permanently to the base 11 by gluing, casting or molding the same therein. In the preferred embodiment, however, the end of the lower rod 18 is bent to form a U-shaped turn 24 which is inserted in a vertical blind hole 25 formed in the base 11. As is best shown in FIG. 4, the U-shaped turn 24 includes a pair of generally parallel legs 26 which are received and frictionally held in the hole 25. The remote end of the rod 18 is bent to form an offset which defines a stop 27 limiting the distance by which the end of the rod may be inserted into the base and a free end 28 which may be grasped and squeezed toward the vertically extending body of the rod 18 to facilitate removal. The free end 28 may be provided with a rubber tip 23 as well.

Figure 6:
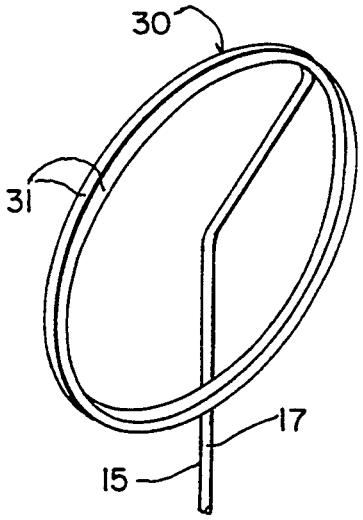
FIG. 6 is an enlarged detail of the spring clip of an alternate embodiment of the invention.

In the alternate embodiment shown in FIG. 6, a modified spring clamp 30 is formed in the upper end of the upper rod 17 in the shape of a pair of abutting circular wire convolutions 31. The wire convolutions 31 provide therebetween a slot into which a card 14 may be slid and subsequently conveniently removed.

In use, a bingo player may want to turn in a bingo card 14, trade it for a new one, purchase another card, or engage in another transaction involving the need to hold a card and/or currency in the air to signal an attendant. With the upper rod 17 in the retracted down position, the player slips the card 14 and/or paper currency upwardly between the twin jaws 21 of the spring clamp 20 and extends the upper rod to its upper extended position by causing the loop 16 on the upper rod to slide vertically along the lower rod 18. The card and/or currency is then held at a height generally equivalent to extended arm height above the table in a position readily visible to an attendant. Most importantly, it eliminates the need for a player to hold the material vertically with arm extended for what may be a fairly considerable length of time until an attendant can reach the players position. Removal of the card and/or currency by the attendant requires that it simply be grasped and pulled downwardly from the jaws 21 of the clamp 20. The materials are easily removable by the attendant using one hand.

Although other types of clips such as spring-biased alligator clips could be used, such clips require two handed operation by both the player and the attendant. Also, other types of vertically extensible members 12 could also be utilized, such as two or more telescoping rods.

The base 11, whether made of wood, molded of plastic, or cast from a suitable metal, may be personalized or provided with a wide variety of designs, logos, or the like.

Referring to the base 11 of the preferred embodiment, it is preferably made from a piece of wood, cut and suitably finished and provided with four cylindrical recesses 32 in its corners. The recesses 32 provide convenient receptacles 34 for other bingo-playing accessories, such as ink markers 33 which are commonly used by bingo players to mark the called numbers on their cards. The receptacles 34 may also be used to hold marking chips used as alternates to ink markers 33. The entire assembly of interconnected wire rods 15, base 11, and accessories such as markers 33 may be packaged and sold as a kit.

Various modes of carrying out the present invention are contemplated as being within the scope of the following claims particularly pointing out and distinctly claiming the subject matter which is regarded as the invention.

I claim:

1. A holder for displaying thin sheet material comprising:

a base;

a pair of extensibly connected elongate members, including a lower member having a lower end attached to the base and an upper member having an upper end for holding the sheet material;

a slide mechanism interconnecting the upper end of the lower member and the lower end of the upper member for relative sliding movement between an upper extended position and a lower retracted position; and, a clip on the upper end of the upper member adapted to receive and releasably hold the sheet material.

2. The invention as set forth in claim 1 wherein each of said elongate members comprises a straight wire rod, and said slide mechanism comprises integral wire loops on the upper and lower ends of the respective lower and upper rods, each of said loops having the wire rod of the other member extending therethrough, said loops being sized and positioned to allow the rods to slide relative and parallel to one another and to be held by friction in any selected position between said extended and retracted positions.

3. The invention as set forth in claim 2 wherein each of said loops lies in a plane forming an acute angle with respect to the wire rod to which it is attached and lying parallel to the plane of the other loop.

4. The invention as set forth in claim 1 wherein said clip comprises a unitary spring clamp formed integrally in the end of the upper wire rod.

5. The invention as set forth in claim 4 wherein the spring clamp includes a pair of downwardly opening friction jaws.

6. The invention as set forth in claim 4 wherein the spring clip comprises a pair of abutting circular wire convolutions.

7. The invention as set forth in claim wherein the lower end of the lower rod is attached to the base with a demountable connection.

8. The invention as set forth in claim 7 wherein said demountable connection comprises:

a U-shaped turn on said lower rod end; and, a vertical hole in the base adapted to frictionally receive and hold therein the legs of said U-shaped turn with the hole axis parallel to the rod.

9. A kit for a bingo player comprising:

a supporting base;

a vertically extensible rod attachable at is lower end to the base and having a clip attached to its upper end;

said clip adapted to releasably hold thin sheet material;

recessed portions in said base providing receptacles; and, bingo accessories removably insertable into said receptacles.

10. The kit as set forth in claim 9 wherein said accessories comprise card markers.

* * * * *